United States Patent [19]

Welker et al.

[11] Patent Number: 4,575,593

[45] Date of Patent: Mar. 11, 1986

[54] ELECTROMAGNETIC RADIATION SUPPRESSING DISTRIBUTOR ROTORS

[75] Inventors: Edward Welker; Lynn A. Rockwell, both of Anderson, Ind.

[73] Assignee: General Motors Corporation, Detroit, Mich.

[21] Appl. No.: 627,815

[22] Filed: Jul. 5, 1984

[51] Int. Cl.[4] ..... H01H 19/00

[52] U.S. Cl. ..... 200/19 DR; 123/633; 174/35 MS

[58] Field of Search ..... 200/19 DR, 19 R, 19 DC; 174/35 MS, 35 SM; 123/633

[56] References Cited

U.S. PATENT DOCUMENTS

| | | | |
|---|---|---|---|
| 4,007,342 | 2/1977 | Makino et al. | 200/19 R |
| 4,186,286 | 1/1980 | Kuo et al. | 200/19 DR |
| 4,208,554 | 6/1980 | Sprague | 200/19 DR |
| 4,332,988 | 1/1982 | Dungan et al. | 200/19 DC |
| 4,349,709 | 9/1982 | Micheli et al. | 200/19 R |
| 4,408,032 | 10/1983 | Sollner et al. | 528/48 |
| 4,419,547 | 12/1983 | Imai et al. | 200/19 R |
| 4,425,485 | 1/1984 | Sone et al. | 200/19 R |

*Primary Examiner*—Harry E. Moose, Jr.
*Assistant Examiner*—Morris Ginsburg
*Attorney, Agent, or Firm*—George A. Grove

[57] ABSTRACT

An ignition distributor rotor electrode provided with a coating of polyester-polyamide-imide varnish suppresses the generation of electromagnetic radiation of radio frequency.

2 Claims, 2 Drawing Figures

ELECTROMAGNETIC RADIATION SUPPRESSING DISTRIBUTOR ROTORS

BACKGROUND OF THE INVENTION

This invention relates to an ignition distributor rotor for suppressing radio frequency interference electromagnetic radiation. More particularly, this invention relates to an ignition distributor rotor having an output electrode coated with a polyester and a polyamide-imide varnish for suppressing such radiation.

There has been considerable effort to modify automotive distributors so that the electrical discharge between the distributor rotor electrode and a corresponding spark plug lead terminal does not generate radiation that interferes with radio reception. For example, it has been proposed to place a resistive or semiconductive element at the tip of the distributor rotor electrode to suppress radiation of radio frequency. It has also been a practice to coat the output segment of a distributor rotor with silicone varnish. Such use of the varnish does effectively reduce radio interference, but the material is relatively expensive and not easily applied to the brass electrode. The art has now developed to the point where there is a need for an inexpensive and easily manufactured distributor rotor electrode that matches or surpasses the performance of the above described practices.

It is an object of the present invention to provide a distributor rotor output electrode that is highly effective in suppressing radio frequency interference. Furthermore, the electrode is easy and inexpensive to manufacture.

It is a more specific object of the present invention to provide a distributor rotor output electrode provided with a coating of polyester and polyamide-imide resins such that, in operation of the distributor, radio interference is reduced to required levels.

BRIEF SUMMARY

In accordance with a preferred embodiment of our invention, these and other objects and advantages are accomplished as follows.

A distributor rotor output electrode is formed by shearing segments of suitable length from a silicon bronze strap having nominal cross section dimensions of, e.g., 5 mm in width×1 mm in thickness. Initially a coil of strap material is coated on its side surfaces with a specific electrically nonconductive varnish. The strap is first coated with a thermosetting polyester resin. A suitable polyester resin is the reaction produce of ethylene glycol and terephthalic anhydride, and a small amount of tris(2-hydroxyethyl) isocyanurate for cross-linking. A layer of the polyester resin is built up on the strap to a thickness of about 0.5 to 1.5 mils (0.013 mm to 0.4 mm) from a solution of the resin. The coating is baked to remove solvent and cross link the thermosettable resin. A second coating is applied over the first. The second coating is initially a solution of an aromatic-aliphatic polyamide-imide resin, preferably the reaction product of an aromatic tricarboxylic acid anhydride, an aromatic diisocyanate and an aliphatic dicarboxylic acid. The polyamide-imide layer is also built up to a thickness of about 0.5 to 1.5 mils (0.013 mm to 0.4 mm) and baked to remove solvent. Thus, the overall thickness of the varnish is about 1 to 3 mils. Electrode segments (e.g., 39 mm long) are cut from the coated coil and mounted on a suitable electrically nonconductive distributor rotor body.

The end of the segment through which the electrical discharge occurs is uncoated. However, the varnish coating is present on the sides of the strap right up to the end of the segment. This arrangement of dielectric polyester-polyamide-imide varnish closely adjacent an uncoated electrode tip is found, in operation of the distributor, to suppress radiation interfering with radio reception.

DESCRIPTION OF THE DRAWINGS

These and other objects of our invention will be more completely understood in view of a detailed description of the invention which follows. Reference will be had to the drawings in which.

DESCRIPTION OF THE PREFERRED EMBODIMENT

Figure 1:
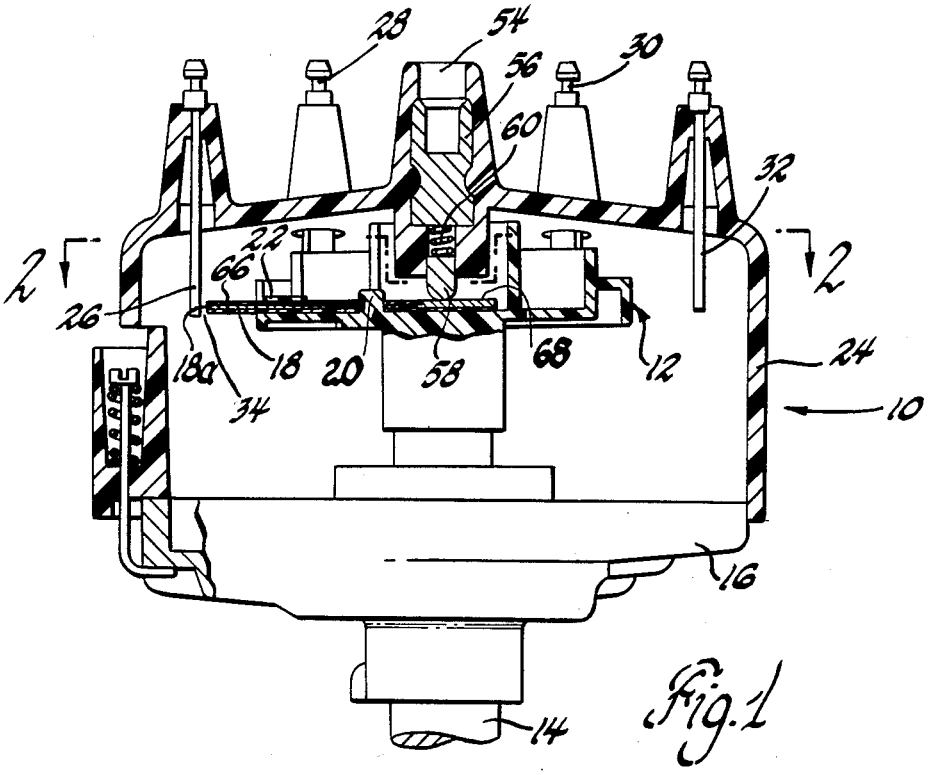
FIG. 1 is an elevation view in partial section of an ignition distributor.

FIG. 1 illustrates a typical internal combustion engine ignition distributor 10 having a rotor member 12 of an insulating material that is rotated in timed relationship with an associated engine by distributor rotor shaft 14. Distributor rotor shaft 14 is journalled for rotation within distributor base 16 as is well known in the automotive art. Carried by rotor member 12 is movable rotor output electrode 18 of an electrically conductive material such as silicon containing bronze. The rotor output electrode 18 extends from the center of rotation of the rotor member 12 to beyond the edge of the rotor member. As seen in FIG. 1, the electrode is rotated on and attached to the rotor by post 20 and by a fused sleeve 22.

Distributor 10 also includes a cover member 24 which carries stationary output electrodes. Four such electrodes 26, 28, 30 and 32 are shown in FIG. 1. In the operation of an internal combustion engine, electrical connectors (not shown in FIG. 1) lead from these electrodes to a spark plug terminal to provide energy for the ignition of a combustible fuel-air mixture in the center of the engine. The stationary electrodes are located in the distributor such that the rotor electrodes 18 sequentially passes in close proximity to the stationary electrodes during each rotation of rotor 12. In FIG. 1 rotor output electrode 18 is shown aligned with stationary output electrode 26 across distributor gap 34. In each rotation of rotor output electrode 18, there is a similar distributor gap momentarily established between it and each of the other stationary output electrodes.

Figure 2:
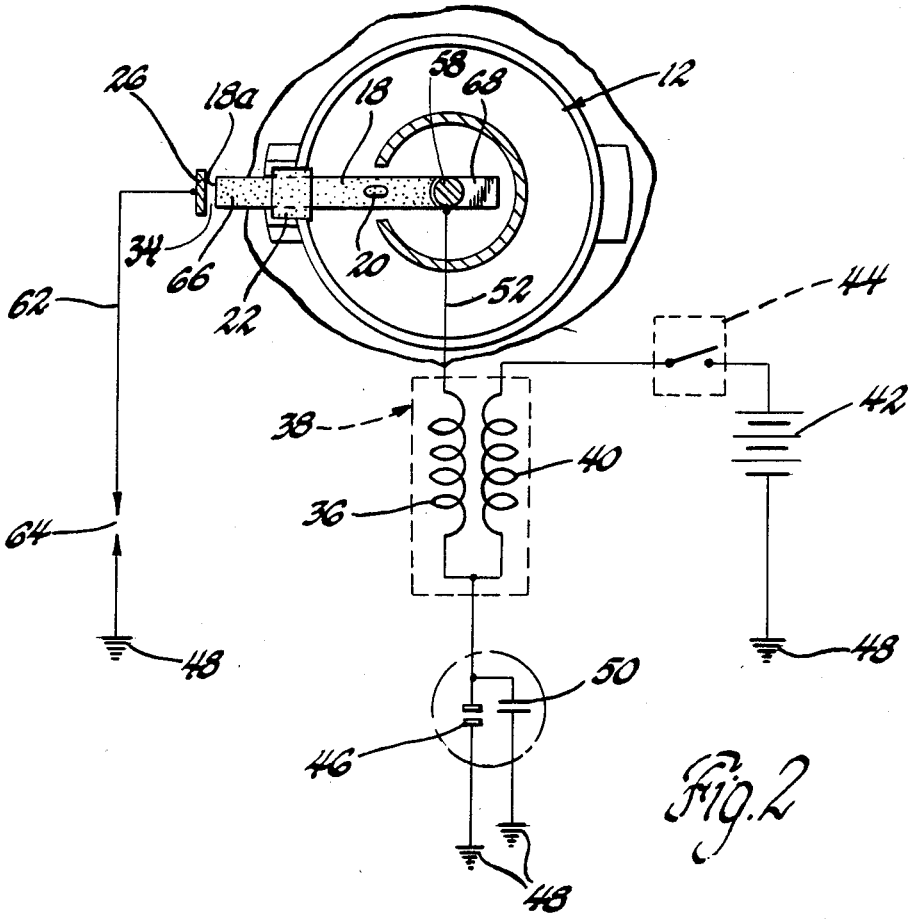
FIG. 2 is a top view of the distributor rotor with a schematic representation of a typical internal combustion engine circuit.

FIG. 2 illustrates one way in which distributor output electrode 18 receives timed impulses of electrical energy to be distributed to the engine spark plugs. The primary winding 40 of a conventional ignition distributor coil 38 is connected across the positive and negative output terminals of a conventional storage battery 42 through the then-closed contacts of a single pole-single throw ignition switch 44 and the ignition distributor breaker contact points 46 and through ground potential 48, respectively. Capacitor 50 is the conventional distributor capacitor connection in shunt across breaker contact points 46. As is well known in the automotive art, breaker contact points 46 are opened and closed in timed relationship with an associated engine by a distributor cam, not shown, that is rotated with distributor shaft 14.

Upon each closure of breaker contact points 46, energizing current flows through primary winding 36 and upon each opening of breaker contact points 46 the energizing current flow is interrupted. Upon the interruption of the primary winding energizing current flow, the resulting collapsing magnetic field induces an ignition spark potential in secondary winding 36 of ignition coil 38. This ignition spark potential is conducted through lead 52 to the distributor input terminal 54 seen in FIG. 1.

Input terminal 54 includes an insert 56 of conductive material such as copper or aluminum and a conductive button 58 may be carbon. As seen in FIG. 1, button 58 is urged by spring 60 into contact with rotor output electrode 18. Consequently, the rotor output electrode 18 is in electrical contact with the secondary winding 36 of the ignition coil 38.

In FIG. 2, stationary output terminal 26 is shown to be connected through spark plug lead 62 to a schematically illustrated engine spark plug 64. With the rotor member 12 positioned as shown, upon the opening of breaker contact points 46 subsequent to a previous closure thereof, the resulting ignition spark potential induced in secondary winding 36 of ignition coil 38 is applied across the electrodes of spark plug 64. The potential is applied through lead 52, distributor input terminal 54, insert 56, spring 60, button 58, rotor output electrode 18, distributor gap 34, stationary electrode 26, lead 62, and spark plug 64 to ground potential 48. Thus, during an ignition event, an electrical arc discharges across distributor gap 34 and the electrodes of spark plug 64. Since there is a distributor gap formed between rotor output electrode 18 and each other stationary output electrode, during the ignition event for each spark plug, there is an electrical spark discharge across the distributor gap corresponding to each spark plug being fired.

While this ignition system has been described in terms of the traditional electromechanical construction, obviously an electronic ignition system could also be employed. Our invention resides in the construction of the distributor rotor electrode and not in specific means for which timed impulses of electrical energy are transmitted to it.

The electrical spark discharge across each distributor gap during engine operation can generate radio frequency interference energy that is radiated by the stationary output electrode and the corresponding spark plug lead on one side of the distributor gap and by the rotor output electrode 18 and the ignition spark potential lead 52 on the other side of the distributor gap. However, we suppress the generation of such electromagnetic radiation by coating the top, bottom and sides of the rotor electrode 18 with a polyester-polyamide-imide varnish 66. The output tip 18*a* of the electrode is not coated with the varnish. However, the sides of the rectangular electrode 18 adjacent the tip 18*a* are coated to a thickness of about 2 mils. The portion (68 in FIG. 2) of the electrode 18 in electrical contact with the terminal button 58 is also free of the varnish coating.

In accordance with our invention, varnish coated distributor rotor output electrodes may readily be prepared by coating a coil of silicone bronze strap material with the specified two-component coating and then cutting individual segments from the coil to a desired length. A suitable strap material, e.g., is rectangular in cross-section, about 5 mm wide and 1 mm thick. The coating material that we prefer is a commercially available magnet wire varnish which in our application suppresses radio frequency interference radiation in the operation of an ignition distributor.

Whether as a coil of several yards of strap material or as discrete segments, the silicon bronze alloy is first coated with a thermosetting polyester. We prefer to employ an ethylene glycol-terephthalic anhydride polyester containing sufficient tris(2-hydroxyethyl) isocyanurate such that the resin is a thermosetting material. The resin is dissolved in a solvent and the strap material continually drawn through the varnish solution. This is normally held between 70°–90° F. The wet coated strap is drawn through a die to provide a uniform coating thickness and then into an oven maintained at about 180° C. to remove solvent and cure the thermosettable resin. The coated strap material may be recoated up to three or four times in the same manner to provide an accumulated coating thickness of the polyester of about 1 mil per side.

The polyester coated strap is then coated in a like manner with a solution of a polyamide-imide. The polyamide-imide coating is built up in three or four layers each by immersion of the strap in a solution of the material and subsequent baking of the material on the strap to remove solvent. The polyamide-imide resin is suitably the reaction product of an aromatic tricarboxylic acid anhydride (such as trimellitic acid anhydride), an aromatic diisocyanate (such as p,p' diphenyl methane diisocynate) and an aliphatic dicarboxylic acid (such as adipic acid) formed in a solution containing an aprotic solvent (such as N-methyl pyrrolidone) at a temperature from about 70° C. to about 160° C. The tricarboxylic acid anhydride component is present in an amount greater than about 25 mole percent of the total acid content. U.S. Pat. No. 4,408,032 describes the preparation of suitable polyamide-imide compositions for use in the practice of this invention. Coatings of this polyamide-imide resin are applied until the total varnish thickness is about 2 mils on each side of the strap, which is generally rectangular in cross section. Thus, the polyester and polyamide-imide layers are approximately of equal thickness.

Rotor electrode segments, e.g. about 39 mm long, are sheared from the coated coil. Obviously the cut ends are uncoated, and this is helpful because the discharge tip 18*a* of the rotor 18 must be uncoated.

We have found that the polyester coating on the copper alloy strap provides excellent adhesion of the varnish while the polyamide-imide outer coating provides excellent wear resistance and durability. The combination of the two layers serves to very effectively provide a distributor rotor output electrode that operates with a very low incidence of radiation of radio frequency. The whole surface of the rotor electrode (such as 18 in the drawing) is coated except for the spark discharge tip 18*a* and for a portion remote from the tip (e.g., portion 68 in FIG. 2) to permit electrical connections with the ignition coil.

There may be some variation in the formulation of the thermosetting polyester resin and the polyamide-imide resin. However, we prefer that the polyester be based on the ethylene glycol-terephthalic anhydride system modified with a trifunctional material such as THEIC to render the polyester heat curable. We prefer a polyamide-imide resin for the top coat because of the improved flexibility and durability that it provides.

R.F.I. testing using the SAE J551C procedure has demonstrated that distributor rotor output electrodes coated as specified result in equal or somewhat lower radiated noise performance than presently used silicone varnish coated electrodes.

While our invention has been disclosed in terms of a specific preferred embodiment, it will be appreciated that other forms could readily be adapted by one skilled in the art. Accordingly, the scope of our invention is to be considered limited only by the following claims.

The embodiments of the invention in which an exclusive property or privilege is claimed are defined as follows:

1. In an ignition distributor of the type wherein a movable electrically conductive electrode with a spark output tip is electrically connected to an ignition coil and is passed with the tip in ignition spark gap relationship with at least one stationary electrode electrically connectable to a corresponding spark plug, the improvement wherein the movable electrode comprises a resistive coating of polyester-polyamide-imide varnish covering the surface of the electrode adjacent the output tip surface, which is not varnish coated, the varnish coating comprising a base layer of thermoset polyester resin and an overlying layer of polyamide-imide resin, the coating having a thickness of about 0.001 to 0.003 inches and being effective to reduce radio frequency interference radiation during electrical discharge across the spark gap between the tip of the electrode and the stationary electrode.

2. A distributor spark output electrode comprising an electrically conductive copper alloy body having a spark discharge tip, the surface of the body adjacent the tip being coated with a varnish comprising a base layer of thermoset polyester resin and an overlying layer of aromatic-aliphatic polyamide-imide resin, the copper alloy body and the coating cooperating to suppress the generation of radio frequency noise when said electrode is employed in an operating automotive distributor.

* * * * *